United States Patent [19]

Ochiai et al.

[11] Patent Number: 4,689,637

[45] Date of Patent: Aug. 25, 1987

[54] PARABOLA ANTENNA HAVING INCREASED MECHANICAL STRENGTH

[75] Inventors: Izumi Ochiai; Hiroshi Kurosawa, both of Tochigi, Japan

[73] Assignee: Hitachi, Ltd., Tokyo, Japan

[21] Appl. No.: 737,479

[22] Filed: May 24, 1985

[30] Foreign Application Priority Data

May 25, 1984 [JP] Japan ..... 59-104562
May 25, 1984 [JP] Japan ..... 59-104563

[51] Int. Cl.[4] ..... H01Q 15/16

[52] U.S. Cl. ..... 343/914; 343/912; 343/840

[58] Field of Search ..... 343/914, 885, 890, 840, 343/912, 913, 915, 916; 350/630

[56] References Cited

U.S. PATENT DOCUMENTS

| | | | |
|---|---|---|---|
| 2,600,274 | 6/1952 | Skhak | 343/840 |
| 2,695,958 | 11/1954 | Lewis | 343/914 |
| 2,960,950 | 11/1958 | Hart, Jr. | 72/378 |
| 3,010,153 | 11/1961 | Bittner | 350/630 |
| 3,136,674 | 6/1964 | Dunkle et al. | 343/912 |
| 3,314,071 | 4/1967 | Lader et al. | 343/912 |
| 3,572,071 | 3/1971 | Semplak et al. | 72/54 |
| 3,599,219 | 8/1971 | Holtum, Jr. et al. | 343/912 |
| 4,144,535 | 3/1979 | Dragone | 343/840 |
| 4,188,358 | 2/1980 | Withoos et al. | 343/912 |
| 4,352,112 | 9/1982 | Leonhardt et al. | 343/912 |
| 4,429,953 | 2/1984 | Zehnpfennig et al. | 350/630 |
| 4,490,726 | 12/1984 | Weir | 343/840 |
| 4,513,293 | 4/1985 | Stephens | 343/914 |

FOREIGN PATENT DOCUMENTS

| | | | |
|---|---|---|---|
| 3019055 | 3/1982 | Fed. Rep. of Germany . | |
| 2550663 | 2/1985 | France . | |
| 1196857 | 7/1970 | United Kingdom | 343/914 |
| 0779559 | 11/1980 | U.S.S.R. | 343/890 |

*Primary Examiner*—Charles Frankfort
*Assistant Examiner*—Thomas B. Will
*Attorney, Agent, or Firm*—Antonelli, Terry & Wands

[57] ABSTRACT

A parabola antenna has a parabola surface whose thickness is uniformly decreased from an outer circumferential portion to a central portion of the parabola surface. The thickness of the parabola surface is smallest at the central portion.

2 Claims, 7 Drawing Figures

PARABOLA ANTENNA HAVING INCREASED MECHANICAL STRENGTH

BACKGROUND OF THE INVENTION

1. Field of the Invention

The present invention relates to a parabola antenna and more particularly to a structure for a parabola antenna for a satellite broadcasting system. It also relates to a method for manufacturing such an antenna.

2. Description of the Prior Art

In conventional parabola antennae, in order to cope with problems of resilient distortion, permanent deformation, damage and the like of parabola surfaces due to the strong wind, there have been effected designs, which are satisfactory in mechanical strength, by increasing the thickness of each of the structural members and providing suitable reinforcements thereto. However, such designs are insufficient to reduce the amount of material required or to save the mounting space to a minimum the greatest possible extent. Thus, there are many problems to be solved for the home use of a parabola antennae in compliance with the recent new application of satellite broadcasting systems.

Referring now to FIGS. 1 and 2, a conventional parabola antenna will be described. FIG. 1 is a partially fragmentary side elevational view of the conventional parabola antenna and FIG. 2 is a rear view of the antenna.

In FIGS. 1 and 2, a parabola surface 1 is mounted on a mounting member 3 through a reinforcement portion 2 and is fixed to a post 4. Electric waves in the air come in the direction indicated by the arrow and are reflected on the parabola surface to be collected by a converter 5. In the antenna shown, the focus of the parabola is offset with respect to the direction of the electric waves, so that shades of the converter 5 and its support 6 are not projected onto the parabola surface 1. Since such an offset type parabola antenna is available for use even in a snowfall, almost all of small size parabola antennae are of the offset type.

The most serious problems in the parabola antennae are the deformation and the damage due to the wind. In order to prevent the accurate parabola surface from being resiliently deformed or from being vibrated at its peripheral portion due to the wind pressure, it is necessary that the outer peripheral portion of the parabola surface 1 be strong enough to resist a force which acts to open the marginal portion of the parabola surface 1. To meet this requirement, a flange 7 is provided along its circumference and the thickness of the parabola surface is also increased.

On the other hand, there is a fear of deformation or damage of the parabola surface 1 due to a bending moment applied to the parabola surface 1 in the vicinity of the mounting portion 2 of the parabola surface. To cope with this, even if the thickness of the parabola surface 1 at the mounting portion 2 of the parabola surface would be rather increased, the mechanical strength thereof would be insufficient. Instead, radial ribs 8 are provided which extend radially outwardly from the mounting portion 2. In such a case, all the moment is applied to the radial ribs 8. Therefore, the effect of the thickness of the central material for the parabola surface 1 is hardly obtained.

As described above, in the conventional antenna, the reinforcements for preventing the deformation of the parabola surface, such as the increased thickness of the marginal portion of the parabola surface and the outer peripheral reinforcement flange 7, and the reinforcements such as the mounting portion 2 resisting against the bending moment applied to the mounting portion due to the wind pressure and the radial ribs 8 for transmitting the moment from the mounting portion, respectively, serve independently of each other. Such a structure as a whole requires a great amount of material.

SUMMARY OF THE INVENTION

An object of the present invention is to provide a light and inexpensive parabola antenna which meets a performance in mechanical strength to the same extent as in the prior art while reducing the required amount of material for the structure of the parabola antenna as much as possible.

Another object of the invention is to provide a parabola antenna which may minimize a mounting space therefor.

In order to meet these and other objects, in accordance with the present invention, there is provided a parabola antenna in which the thickness of the parabola surface is uniformly decreased from the outer marginal portion to the central portion so that the thickness of the central portion is most decreased.

DETAILED DESCRIPTION OF THE PREFERRED EMBODIMENTS

A principle of the invention will now be described. The present invention resides in the provision of a dish reflector having a parabola surface. More specifically, upon reviewing the dish reflector, the deformation of the parabola surface with respect to the other parts due to the wind pressure is reduced since the thickness thereof is uniformly increased from the center to the circumferential portion, and the circumferential portion tends to open outwardly by a circumferential stress. In order to maintain the deformation below the allowable range limit against such stress, reinforcements such as a flange are provided at the outer circumferential portion and the thickness of the parabola surface is increased toward the circumferential portion. On the other hand, since the wind pressure acts as a surface stress in the central portion of the parabola surface, it is sufficient that the parabola surface may resist a tension or compression stress within the surface. Therefore, the thickness in the central portion may be thinner than that at the circumferential portion.

Also, in the case where the dish reflector is mounted on a post, the contact portion between the rear thereof and the post must increase its thickness because the contact portion is subjected to the bending moment toward the outside of the surface due to the wind pressure. In general, the contact portion is provided with a reinforcement in order to increase the cross-section coefficient more than that at the other portion. However, in the contact portion, a flange provided at an outer circumferential portion for preventing the deformation is effectively used because the thickness of the circumferential portion is greater than any other thickness, thereby reducing the necessary amount of the reinforcement members.

Figure 3:
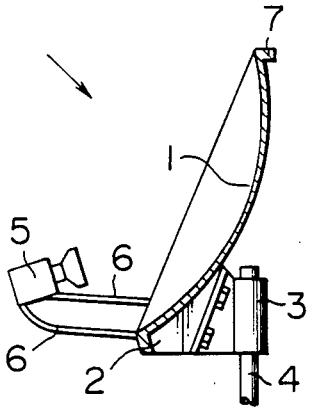
FIG. 3 is a partially fragmentary side elevational view of one embodiment of the present invention.
Figure 4:
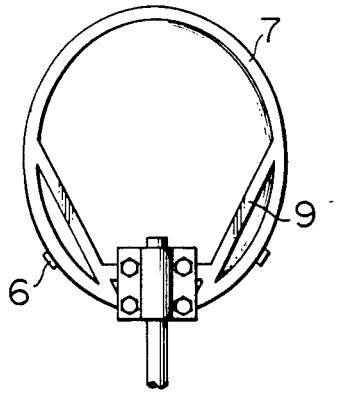
FIG. 4 is a rear view of the embodiments shown in FIG. 3.

FIGS. 3 and 4 show an embodiment of the invention based upon the above-described principle. FIG. 3 is a partially fragmentary side elevational view of a parabola antenna and FIG. 4 is a rear view of the parabola antenna.

In the parabola antenna shown in FIGS. 3 and 4, the thickness of the dish reflector having a circumferential portion of a parabola surface 1 and the configuration of an outer marginal flange 7 are substantially the same as those in the prior art in order to prevent a deformation of the parabola surface due to the wind pressure. However, according to the invention, the thickness of the dish reflector having the parabola surface 1 is uniformly decreased from the circumferential portion to the central portion so that the dish reflector is thinnest in the central portion. This is based upon the fact that the wind pressure solely acts as a surface force within the parabola surface. Therefore, it is unnecessary to increase the thickness of the central portion of the dish reflector. Thus, the unnecessary material may be saved.

A mounting portion 2 of the dish reflector is located at the outer circumferential portion thereof. A large bending moment is applied to the mounting portion 2 of the parabola antenna connected through a mounting member 3 to a post 4. However, the mounting portion 2 is connected to the strong outer marginal or circumferential flange 7 and reinforcement ribs 9 coupled to the flange 7. Thus, the bending moment caused by the wind pressure and a reaction force of the post is transmitted to these reinforcement members and the moment is not applied to the dish reflector. Therefore, there is no problem in the case where the thickness of the dish reflector having the parabola surface 1 is decreased in the central portion thereof. Also, the material of the reinforcement ribs 9 may be reduced corresponding to the cross-section coefficient of the marginal flange 7.

As described above, the present invention is very effective in reducing the material cost and the weight of the parabola antenna.

Figure 1:
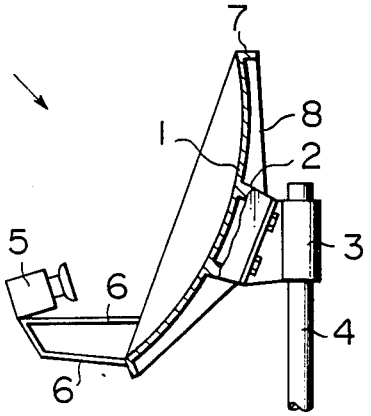
FIG. 1 PRIOR ART
FIG. 1 is a partially fragmentary side elevational view of one example of a conventional parabola antenna.
Figure 2:
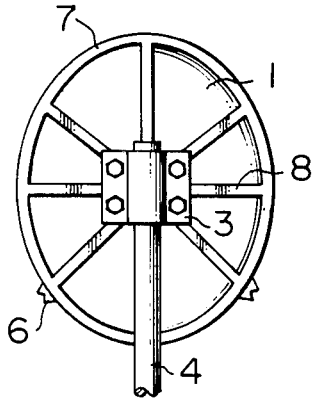
FIG. 2 PRIOR ART
FIG. 2 is a rear view of the antenna shown in FIG. 1.

Also, in the embodiment shown in FIGS. 3 and 4, since the coupling section between the mounting portion 2 and the mounting member 3 is located at the marginal portion of the lower half of rear surface of the dish reflector having the parabola surface 1, the dimension from the post 4 to the convertor 5 may be reduced more than the coventional arrangement shown in FIGS. 1 and 2 in which the mounting portion 2 is located at the central portion of the dish reflector. Therefore, according to the invention, the mounting space for the parabola antenna may be effectively reduced.

It is understood that the material for the parabola antenna is not limited to FRP (fiber reinforced plastics) but the present invention may be similarly applied to the parabola antenna using metallic material. In case of use of metallic material, the configurations of the mounting portion and the reinforcement members are modified to meet its requirements. According to the invention, it is possible to make thinner the central portion of a parabola surface of, for example, 600 mm diameter than the circumferential portion thereof by 4.5 to 5.0%.

A method for manufacturing a dish reflector having a parabola surface of the above described parabola antenna will now be described.

Conventionally, in case of manufacturing a metallic spherical shell part having a gentle slope, for example, for the parabola antenna, a metal plate is pressed between male and female molds having concave and convex shapes. Therefore, the following defects should be overcome. Namely, since the male and female molds are required and it is difficult to control an operational gap for machining a thin plate, an expensive mold must be used.

Also, since a gentle sloped surface is molded by the male and female molds, a great amount of spring-back is inevitable, and since there ia an inevitable non-uniformity in friction with the molds, the spring-back becomes non-uniform. Also, since it is difficult to predict the shape of the product after the pressing operation, a high cost is required to conduct trial tests of the molds and its machining accuracy is not satisfactory.

Furthermore, according to the conventional method, during the initial machining step of a curved portion whose contact area with the molds are small, the material is not restricted by the molds. As a result, creases are liable to be generated in the machined product body. It is also difficult to obtain a smooth surface by the mold contact.

In view of the above-noted various defects, a manufacturing method in accordance with the invention is characterized in that a circumferential reinforcement which is formed in advance in the circumferential portion of the parabola antenna is clamped.

More specifically, in accordance with the present invention, a single one-sided mold is provided for forming a curved portion to thereby reduce the mold cost and the associated fluid pressure and a concave mold are used. Furthermore, the curved portion to be molded is not brought into contact with the mold until the final step is carried out. Since a tension may be always applied to the curved portion to be molded by the action of the fluid pressure, it is possible to prevent creases from being generated in the machined product body and at the same time, a possible spring-back may be minimized to thereby form a curved surface having a high accuracy. Furthermore, the circumferential reinforcements which are formed in advance are clamped so that it is possible to remove a deterioration of the surface accuracy due to the resiliency change upon machining the reinforcements after forming the curved surface in accordance with a general press molding.

A method for manufacturing a parabola surface in accordance with the invention will now be explained in conjunction with an apparatus for carrying out the method.

Figure 5:
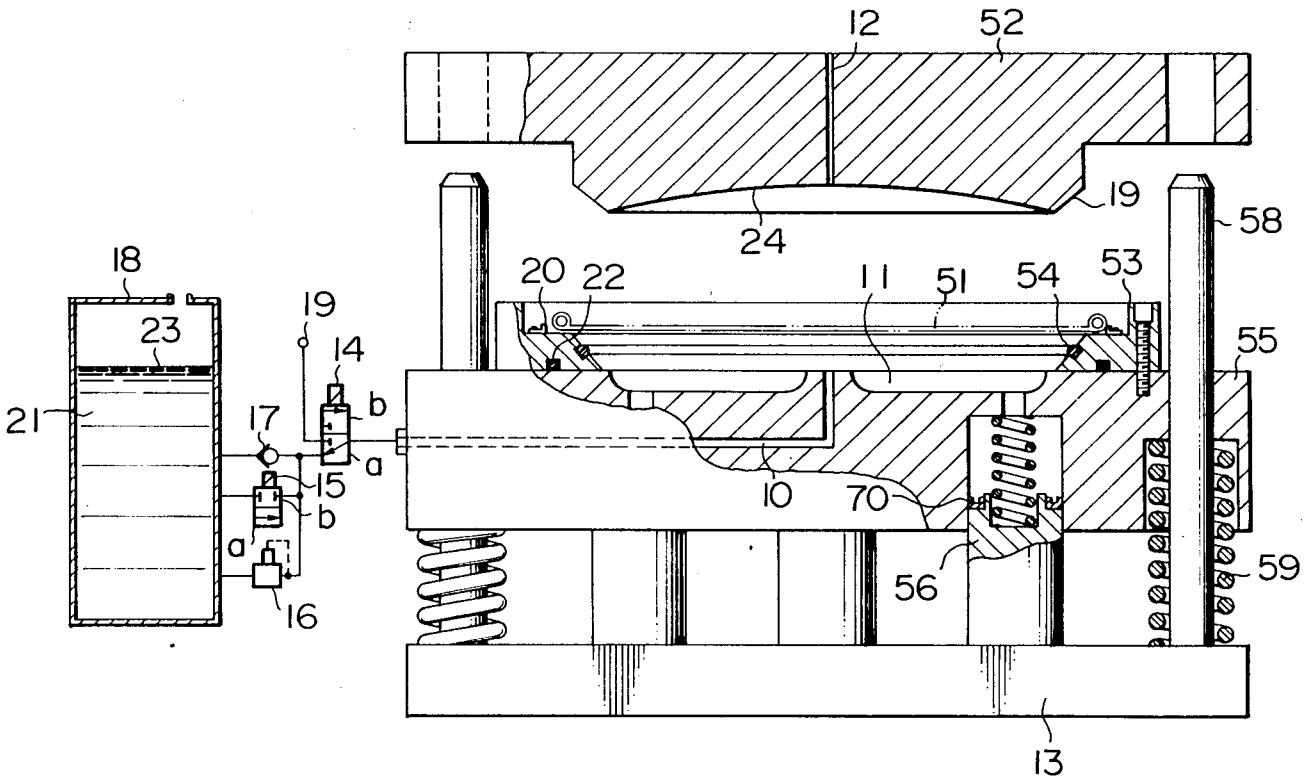
FIG. 5 shows a manufacturing apparatus illustrating one embodiment of a manufacturing method for the antenna of the present invention.

FIG. 5 is a view showing one embodiment of the manufacturing method in accordance with the invention and involving an apparatus for molding a metallic parabola antenna using a single movable pressing machine.

A work piece 51 of metal plate which is in the form of a disc having curlings at a circumference is inserted in alignment with stops 20.

A receiving mold 55 and a hydraulic piston 56 are filled in advance with a press oil 21 to an oil level 23 with an electromagnetic valve 14 being set at a position a and an electromagnetic valve 15 being set at a position a. At a moment when a press upper ram moves in a machining stroke, the electromagnetic valve 15 is brought into a position b so that a mold 52 fixedly secured to the press upper ram descends and the work piece 51 is clamped between a clamp portion 19 and a clamp receiving mold 53 while molding a flange.

A seal member 54 such as an O-ring for preventing a leakage of the press oil serves to keep a sealing effect between the work piece 52 and the clamp receiving mold 53. A seal member 22 such as an O-ring serves to keep a sealing effect between the clamp receiving mold 53 and the receiving mold 55.

When the press upper ram is moved downwardly against the spring force of springs 59 for supporting the receiving mold 55 along lower portions of guide posts 58, the hydraulic piston 56 is clamped between the receiving mold 55 and the stationary platen 13, thereby supplying oil between the receiving mold 55 and the work piece 51.

The work piece 51 is inflated by the hydraulic pressure and is pressed against the mold 52 having a concave spherical shell-shaped curved surface 24.

When air between the work piece and the spherical shell-shaped curved surface 24 of the convex mold 52 is discharged through a small diameter vent hole 12 and the work piece 51 is brought into intimate contact with the mold 52 by the hydraulic pressure, the pressure of the press oil 21 between the receiving mold 55 and the work piece 51 is abruptly increased by the action of the hydraulic piston 56. At this time, the extra press oil 21 is returned back to an oil reservoir 18 passing through a pressure regulating valve 16 via an oil release passage 10 while the oil pressure is being adjusted at a predetermined level. Reference numeral 70 denotes an oil seal, and reference numeral 11 denotes an oil groove.

Then, the press upper ram is raised, the press oil 21 needed for returning the hydraulic piston 56 is replenished through the check valve 17, and the mold 52 is separated from the work piece 51. Thereafter, the electromagnetic valve 14 is changed over the position b, thereby blowing compression air into the work piece interior, Then, the shell product is removed from the press oil 21.

The press upper ram is stopped at the top dead center. The molded shell-shaped product is removed therefrom. The electromagnetic valve 14 is returned back to the position a and the electromagnetic valve 15 is returned back to the position a, thereby returning the oil level 23 to a predetermined level.

Thereafter, a next work piece is set in the apparatus and the above-described series steps are repeated to thereby mold a shell-shaped product.

In the method for producing the parabola surface in accordance with the invention, the metal plate is clamped at its circumference where reinforcements are formed. The plate is inflated from the inside by hydraulic pressure or pneumatic pressure and is pressed outwardly against a concave mold, thereby performing the molding operation. The molded metal plate is subjected to a plastic deformation while receiving a uniform inner tension. Therefore, after the completion of the molding process, when the product is removed by decreasing the pressure, the product is subjected to a uniform resilient restoration but the restoration mainly takes place within the product. A deformation due to the spring-back, outside the product, which causes its curvature to be changed is very small. Accordingly, an extremely high accuracy may be obtained like a tension bending with a tension exceeding a yield point.

Also, since the inward surface of the concave surface of the metal parabola antenna is not brought into contact with a metal mold or the like at all, there is no fear that damage due to the mold contact would take place. Also, since an inner surface of the concave mold 52 is subjected to the fluid pressure alone through the work piece, even if metal chips or foreign matter are entrained in the mold, the inner surface of the concave mold would not be damaged.

Figure 6:
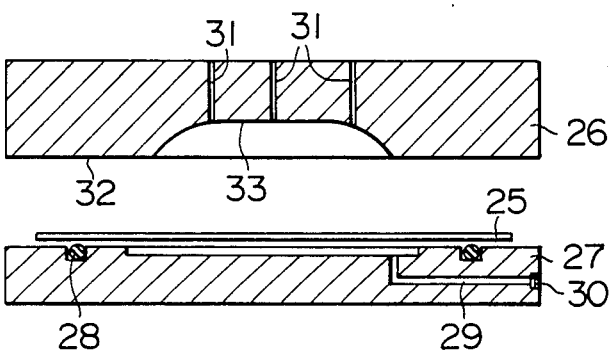
FIGS. 6 and 7 show the outer manufacturing apparatus pertaining to the antenna of the present invention.
Figure 7:
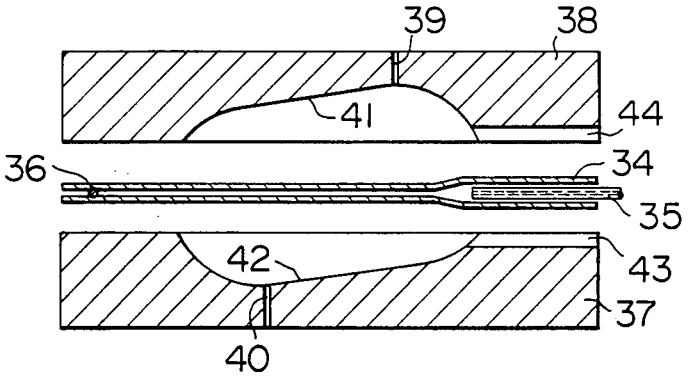

FIGS. 6 and 7 are views showing other embodiments of a metal mold and receiving mold for illustrating a method for manufacturing a product in accordance with the invention. Unlike the embodiment shown in FIG. 5, a pressure unit is formed separately from the metal mold and the receiving mold but is hydraulically connected to the metal and receiving molds from the outside thereof.

In FIG. 6, a mold 26 has a planare clamp portion 32 whose area is sufficient to prevent a peripheral portion of the work piece 25 from being entrained into the molding section. The work piece 25 is laid on a receiving mold 27. Thereafter, the mold 26 is lowered to clamp the work piece 25 and a fluid section is sealed by a seal member 28 such as an O-ring. After clamping the work piece 25, a piping from the outside pressure unit (not shown) is coupled to a connecting portion 30, and a pressure of fluid is applied between the work piece 25 and the receiving mold 27 through a connecting passage 29 formed in the receiving mold 27. Thus, the work piece 25 is molded into a shell-shaped curved surface 33 for the parabola surface. Reference numeral 31 denotes vent holes.

FIG. 7 shows an embodiment of metal molds for manufacturing shells for parabola antenna by using a bag-like work piece. In FIG. 7, the bag-like work piece 34 is clamped between the mold 37 and the mold 38, and a pressure of fluid is applied thereto from a fluid supply inlet, so that the work piece 34 is molded in conformity with shell-like curved surfaces 41 and 42 of the molds. Thereafter, the clamped portions are molded or machined. Thus, container products and paired shells are produced.

As described above, in accordance with the invention, a work piece is clamped along its outer peripheral portion and is inflated from one side and a plastic machining is carried out for manufacturing a product having a large radius of curvature. Therefore, there is no local elongation of the material, and any possible deformation or crease may be prevented from being generated. In addition, there is no fear that a damage or fault due to the mold contact or the like would take place.

We claim:

1. A parabola antenna comprising a dish reflector having a main parabola surface and a rear curved surface, said dish reflector having a thickness which is uniformly decreased from the outermost circumferential portion to a central portion of said parabola surface, the thickness of said dish reflector being smallest at the central portion of said parabola surface, the outermost circumferential portion of said dish reflector being provided with a reinforcement flange for stablizing said parabola surface, said rear curved surface of said dish reflector being provided exclusively at its lowermost portion adjacent said reinforcement flange with a connecting extension member adapted to be mounted on a post, and sair rear curved surface of said dish reflector being provided with a reinforcement rib on each side of said reinforcement flange extending from said reinforcement flange adjacent said connecting extension member with a chord-like disposition with respect to the circumference of said dish reflector, whereby said parabola antenna has an increased mechanical strength with reduced weight.

2. A parabola antenna according to claim 1, wherein said reinforcement flange for stablizing said parabola surface comprises metallic material.

* * * * *